US011069959B1

(12) United States Patent
Kaistha et al.

(10) Patent No.: US 11,069,959 B1
(45) Date of Patent: Jul. 20, 2021

(54) MONOLITHIC RADIATING ELEMENTS AND FEEDBOARD ASSEMBLIES FOR BASE STATION ANTENNAS FORMED VIA LASER DIRECT STRUCTURING AND OTHER SELECTIVE METALLIZATION TECHNIQUES

(71) Applicant: CommScope Technologies LLC, Hickory, NC (US)

(72) Inventors: Amit Kaistha, Coppell, TX (US); Jonathon Veihl, New Lenox, IL (US)

(73) Assignee: CommScope Technologies LLC, Hickory, NC (US)

( * ) Notice: Subject to any disclaimer, the term of this patent is extended or adjusted under 35 U.S.C. 154(b) by 546 days.

(21) Appl. No.: 16/093,469

(22) PCT Filed: May 4, 2017

(86) PCT No.: PCT/US2017/031008
§ 371 (c)(1),
(2) Date: Oct. 12, 2018

(87) PCT Pub. No.: WO2017/192819
PCT Pub. Date: Nov. 9, 2017

Related U.S. Application Data

(60) Provisional application No. 62/332,509, filed on May 6, 2016.

(51) Int. Cl.
*H01Q 1/24* (2006.01)
*H01Q 21/06* (2006.01)
(Continued)

(52) U.S. Cl.
CPC ..... *H01Q 1/246* (2013.01); *H01Q 9/28* (2013.01); *H01Q 21/062* (2013.01);
(Continued)

(58) Field of Classification Search
CPC ..... H01Q 1/246; H01Q 9/28; H01Q 21/062; H01Q 21/08; H01Q 21/26; H01Q 1/42; H01Q 9/04
See application file for complete search history.

(56) References Cited

U.S. PATENT DOCUMENTS

2002/0163477 A1 11/2002 Eriksson
2004/0217910 A1 11/2004 Montgomery et al.
(Continued)

FOREIGN PATENT DOCUMENTS

CN 204885425 12/2015
EP 2950385 12/2015
WO 2017/165512 A1 9/2017

OTHER PUBLICATIONS

International Search Report and Written Opinion of the International Searching Authority, International Application No. PCT/US2017/031008, dated Aug. 8, 2017, 17 pp.
(Continued)

*Primary Examiner* — Joseph J Lauture
(74) *Attorney, Agent, or Firm* — Myers Bigel, P.A.

(57) ABSTRACT

A method of fabricating a monolithic feedboard assembly for a base station antenna, the method comprises injection molding a unitary frame that includes a feedboard section and at least one radiating element section and then selectively depositing metal on the unitary frame to form radio frequency transmission lines and radiators on the unitary frame to provide the monolithic feedboard assembly.

19 Claims, 5 Drawing Sheets

(51) Int. Cl.

| | |
|---|---|
| ***H01Q 9/28*** | (2006.01) |
| ***H01Q 21/26*** | (2006.01) |
| ***H01Q 21/08*** | (2006.01) |
| *H01Q 9/04* | (2006.01) |
| *H01Q 1/42* | (2006.01) |

(52) U.S. Cl.
CPC ..... *H01Q 21/08* (2013.01); *H01Q 21/26* (2013.01); *H01Q 1/42* (2013.01); *H01Q 9/04* (2013.01)

(56) References Cited

U.S. PATENT DOCUMENTS

| | | | | |
|---|---|---|---|---|
| 2005/0001778 | A1 | 1/2005 | Le et al. | |
| 2012/0280882 | A1 | 11/2012 | Zimmerman et al. | |
| 2013/0285877 | A1* | 10/2013 | Desclos ..... | H01Q 5/371 343/872 |

OTHER PUBLICATIONS

Panasonic, "MIPTEC 3D Packaging Devices", downloaded Oct. 11, 2018 from https://www3.panasonic.biz/ac/e/tech/mid/miptec/index.jsp, 5 pp.

Molex, "MID / LDS Technology", downloaded Oct. 11, 2018 from https://www.molex.com/molex/capabilities/capabilities.jsp?key=mid_lds_technology, 6 pp.

Molex, "MediSpec MID/LDS Capabilities", downloaded Oct. 11, 2018 from https://www.molex.com/molex/products/family?key=medispec_midlds_capabilities&, 5 pp.

First Office Action issued in corresponding Chinese Patent Application No. 201780027952.4, dated Feb. 3, 2020, including English translation (10 pages).

* cited by examiner

MONOLITHIC RADIATING ELEMENTS AND FEEDBOARD ASSEMBLIES FOR BASE STATION ANTENNAS FORMED VIA LASER DIRECT STRUCTURING AND OTHER SELECTIVE METALLIZATION TECHNIQUES

CROSS-REFERENCE TO RELATED APPLICATIONS

The present application is a 35 U.S.C. § 371 national stage application of PCT Application No. PCT/US2017/031008, filed on May 4, 2017, which itself claims priority to U.S. Provisional Patent Application Ser. No. 62/332,509, filed May 6, 2016, the entire contents of both of which are incorporated herein as if set forth in their entireties. The above-referenced PCT Application was published in the English language as International Publication No. WO 2017/192819 A1 on Nov. 9, 2017.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells," and each cell is served by a base station. The base station may include one or more base station antennas that are configured to provide two-way radio frequency ("RF") communications with mobile subscribers that are geographically positioned within the cells served by the base station. In many cases, each base station provides service to multiple "sectors," and each of a plurality of antennas will provide coverage for a respective one of the sectors.

Base station antennas typically are implemented as phased array antennas. In one typical implementation, a base station antenna will include between 5 and 20 "radiating elements" that are arranged in a vertically-oriented linear array. The individual radiating elements may comprise, for example, dipole or patch radiating antenna elements. Each radiating element may be designed to have a beamwidth in the azimuth plane that corresponds to the angle subtended by the "sector" that the base station antenna is designed to serve. For example, in a base station that includes three base station antennas that each serve a 120 degree sector in the azimuth plane, each radiating element in the linear array may have a half-power beamwidth in the azimuth plane of about 60-65 degrees to provide 120 degree coverage (or slightly more) in the azimuth plane. Typically the beamwidth of the individual radiating elements in the elevation plane will exceed a desired elevation beamwidth (desired elevation beamwidths are often in the 8-20 degree range). By providing a plurality (e.g., 5-20) radiating elements that all receive the same radio frequency (RF) signal, and by providing a phase taper to the sub-components of the RF signals that are fed to each radiating element, the elevation beamwidth of the linear array may be reduced to be within the desired range even though the elevation beamwidth of the individual radiating elements exceeds the desired elevation beamwidth. In some cases, a two-dimensional array of radiating elements may be provided which allows shrinking the beamwidth of the antenna beam in both the azimuth and elevation planes.

DETAILED DESCRIPTION

Pursuant to embodiments of the present invention, radiating elements and feed board assemblies for base station antennas are provided that are formed by selectively depositing conductive traces and other conductive features on injected molded plastic frames. These radiating elements and feedboard assemblies may be formed as monolithic units, decreasing the number of different parts included in the base station antenna. The use of such monolithic radiating elements or feedboard assemblies may significantly reduce the number of solder joints required in the assembly of the antenna, thereby reducing both assembly time and cost. Moreover, as poor solder joints may be a source of passive intermodulation (PIM) distortion, the reduction in solder joints may also reduce the amount of PIM distortion testing required on each antenna and result in better performing antennas. In some embodiments, directors and director supports may be formed as part of the monolithic structures, further reducing the number of parts and assembly time for the antenna.

In some embodiments, laser direct structuring may be used to selectively metalize injection molded frames to form the radiating elements and feedboard assemblies. The selectively deposited metal may use metal materials that exhibit good PIM distortion performance. The metallization geometry may be constructed to form transmission lines and other structures on the injection molded plastic resin that exhibit desired electrical properties such as low return loss values, high power handling capabilities, low PIM distortion, low insertion loss and the like.

In other embodiments, selective metallization techniques other than laser direct structuring may be used such as, for example, vacuum metallization, electroless metal plating or microscopic integrated processing technology (MIPTEC), to form monolithic radiating elements and feedboard assemblies for use with base station antennas.

Embodiments of the present invention will now be described in further detail with reference to FIGS. 1A-5B.

Figure 1A:
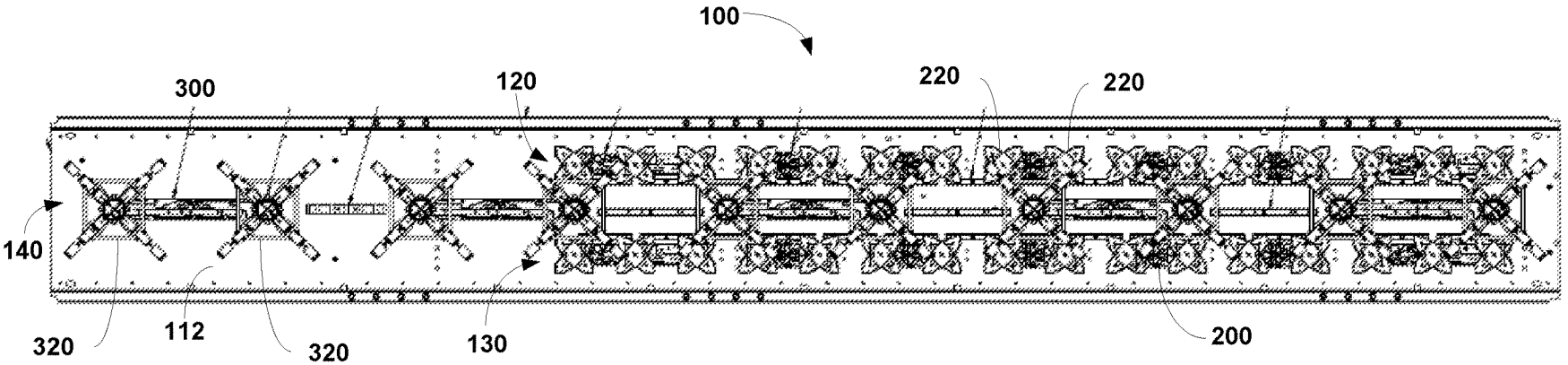
FIGS. 1A-1B are a front view and a side view, respectively, of a base station antenna according to embodiments of the present invention.
Figure 1B:
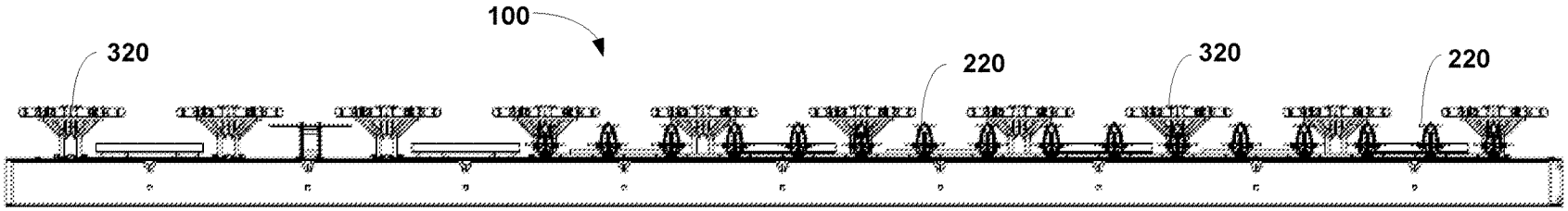

Referring first to FIGS. 1A-1B, a base station antenna 100 according to embodiments of the present invention is shown.

In particular, FIG. 1A is a front view of a base station antenna 100, and FIG. 1B is a side view thereof. As shown in FIGS. 1A-1B, the base station antenna 100 is an elongated structure that has a generally rectangular shape. The antenna 100 may be mounted for use in a vertical orientation so that the longitudinal axis of the antenna extends generally perpendicular to the ground. The antenna 100 is typically mounted within a protective radome (not shown) that provides environmental protection.

The antenna 100 includes a ground plane structure 110 and a plurality of radiating elements 220, 320. Various mechanical and electronic components of the antenna (not shown) may be mounted behind the ground plane structure 110 (i.e., opposite the radiating elements 220, 320). These electronic and mechanical components may include, among other things, connectors, cables, phase shifters, remote electronic tilt ("RET") units, mechanical linkages, diplexers, and the like. The ground plane structure 110 may include a reflector 112, and the radiating elements 220, 320 may be mounted to extend forwardly from the reflector 112. The reflector 112 may comprise a metallic surface that redirects radio frequency (RF) energy that is emitted by the radiating elements 220, 320 towards the back of the antenna 100 back in the forward direction. The reflector 112 may also serves as a ground plane for the radiating elements 220, 320.

The radiating elements 220, 320 may be categorized as high band radiating elements 220 and low band radiating elements 320. The high band radiating elements 220 are mounted in first and second vertically-oriented columns (note that, when mounted, the antenna 100 will be rotated 90 degrees in the counter-clockwise direction from the orientation shown in FIGS. 1A-1B) to form first and second linear arrays 120, 130 of high band radiating elements 220. The low band radiating elements 320 may be mounted in a third vertically-oriented column to form a third linear array 140 that extends in between the first and second linear arrays 120, 130. The low band radiating elements 320 may be configured to transmit and receive signals in a first frequency band (e.g., the 694-960 MHz frequency band or a portion thereof). The high band radiating elements 220 may be configured to transmit and receive signals in a second frequency band (e.g., the 1.695-2.690 GHz frequency band or a portion thereof). The first and second linear arrays 120, 130 of high band radiating elements 220 may be configured to form two separate antenna beams or may be configured to form a single antenna beam, depending upon the feed structure (not shown) provided in antenna 100.

As can be seen best in FIG. 1A, the high band radiating elements 220 may be grouped in groups of two or three radiating elements. When radiating elements are grouped in this manner, a single printed circuit board structure called a feedboard that includes RF transmission lines thereon is typically used to pass RF signals between the radiating elements and circuitry located behind the ground plane structure of the antenna. The combination of such a feedboard and its associated radiating elements is often referred to as a "feedboard assembly."

Figure 2A:
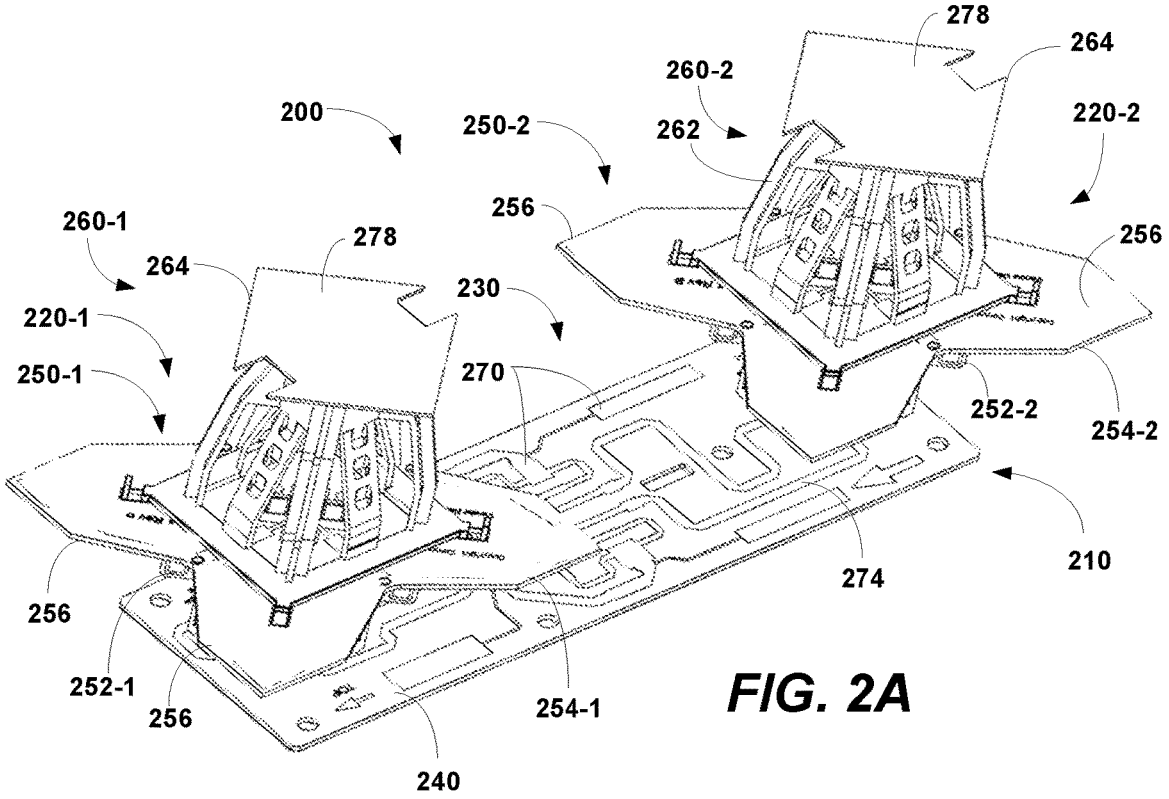
FIG. 2A is a perspective view of a monolithic feed board assembly according to embodiments of the present invention that is included in the base station antenna of FIGS. 1A-1B.
Figure 2B:
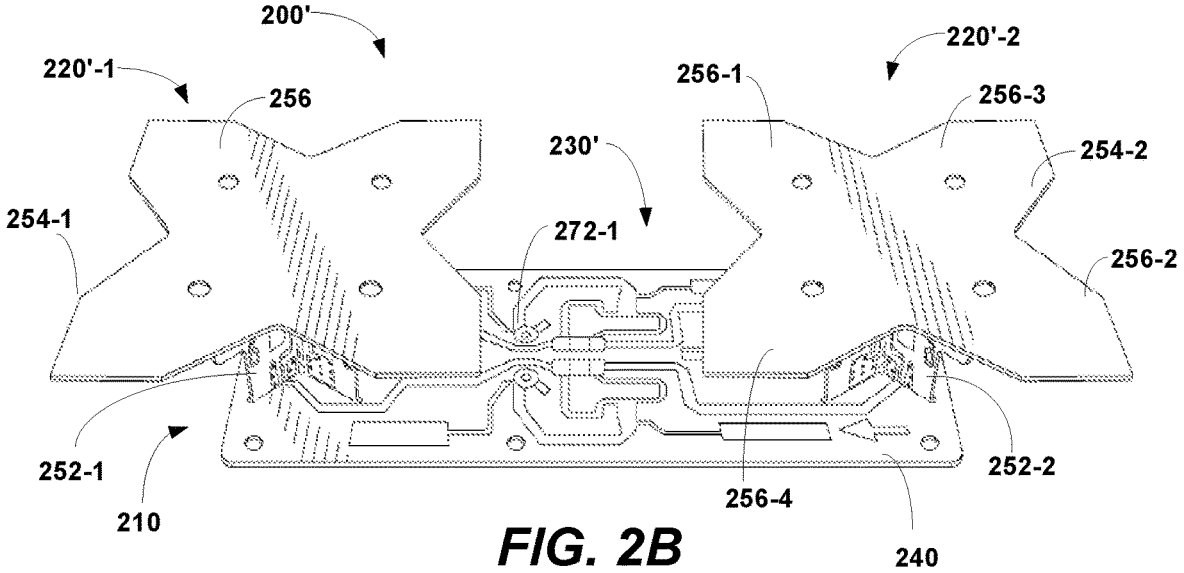
FIG. 2B is a perspective view of a monolithic feed board assembly according to further embodiments of the present invention that may be used in place of the monolithic feedboard assembly of FIG. 2A.
Figure 2C:
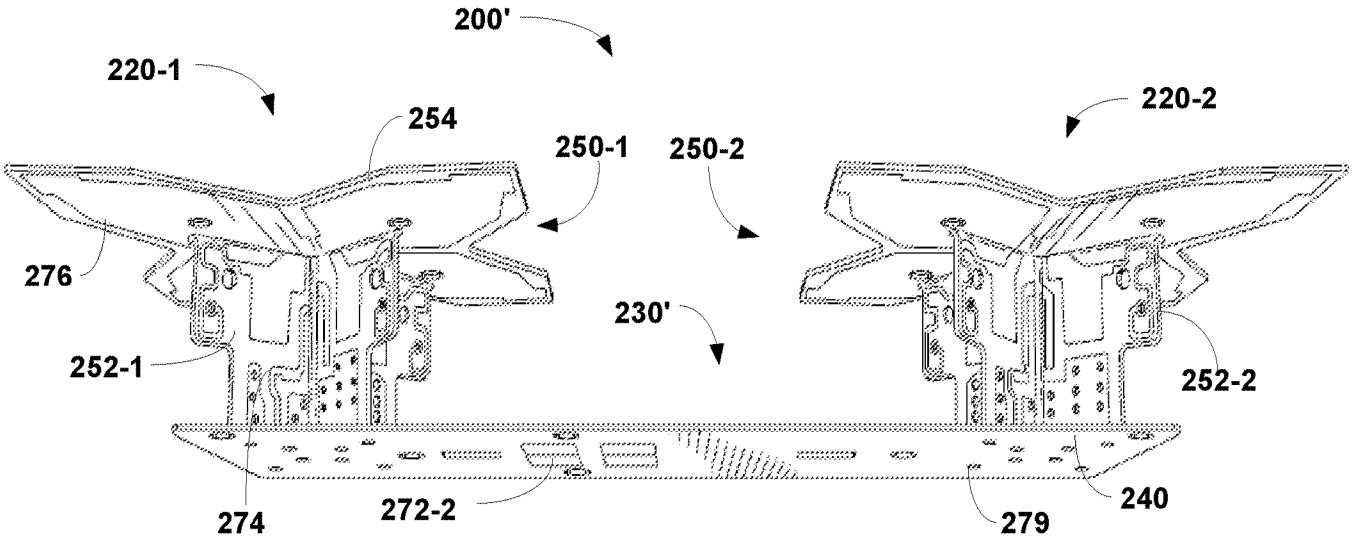
FIG. 2C is a side perspective view of the monolithic feed board assembly of FIG. 2B.

The antenna 100 according to embodiments of the present invention may include high band feedboard assemblies 200 that are formed as fully monolithic structures by selectively depositing metal on an injection molded plastic frame. FIG. 2A is a perspective view of a monolithic feedboard assembly 200 according to embodiments of the present invention that is used to implement the high band feedboard assemblies in the base station antenna 100. FIGS. 2B and 2C illustrate an alternative monolithic feedboard assembly 200' that may be used in place of the high band feedboard assemblies 200. The feedboard assembly 200' of FIGS. 2B-2C may be identical to the feedboard assembly 200 of FIG. 2A except that the feedboard assembly 200' does not include the directors 278 and director support sections 260 that are included in each radiating element 220 in the feedboard assembly 200.

As shown in FIG. 2A, the feedboard assembly 200 comprises a feedboard 210 and a pair of radiating elements 220-1, 220-2 that are together formed as a single monolithic element. Herein, when multiple instances of a structure are provided, these structures may be referred to individually by their full reference numeral (e.g., radiating element 220-2) and collectively by the first (common) part of their reference numerals (e.g., the radiating elements 220). The feedboard 210 and the radiating elements 220-1, 220-2 that comprise the monolithic feedboard assembly 200 may be formed using an injection molded plastic frame 230 that has metal patterns 270 selectively deposited thereon. The frame 230 may include a generally planar feedboard section 240 and first and second radiating element sections 250-1, 250-2 that extend upwardly from the feedboard section 240. The feedboard section 240 may be mounted on the reflector 112, either on the front side or back side thereof and may be coplanar with the reflector surface. The radiating element sections 250-1, 250-2 of the frame 230 may include stalk sections 252-1, 252-2 (barely visible in FIG. 2A, but identical stalk sections 252-1, 252-2 are shown in FIGS. 2B and 2C) and dipole sections 254-1, 254-2. The stalk sections 252 may extend generally perpendicularly to the feedboard section 240. The stalk sections 252 may position the respective dipole sections 254 at a desired distance above the reflector 112 (see FIGS. 1A-1B). For example, the stalk sections 252 may position the respective dipole sections 254 at a distance of about a quarter of a wavelength corresponding to the center frequency of the frequency band of operation of the high band radiating elements 220 above the reflector 112. The dipole sections 254 may be generally planar in some embodiments. The dipole sections 254 may include four radially extending arms 256 that provide surfaces fir forming a crossed-dipole radiating element.

The frame 230 further includes a director support sections 260-1, 260-2 that extend upwardly from each respective radiating element section 250-1, 250-2. The director support sections 260 may include a plurality of legs 262 as shown, although in other embodiments each director support section 260 may include a single leg 262. Each director support section 260 includes a planar section 264 that is mounted at the distal end of the leg 262. Directors 278 may be formed on each planar section 264 via selective metallization, as will be discussed in further detail below.

The frame 230 may comprise a monolithic structure that may be formed, for example, by injection molding a plastic resin. Top and bottom portions of the stalk sections 252 may be thicker than the central portions thereof and may merge into the feedboard section 240 and the dipole sections 250 along curved surfaces (this can best be seen in the alternative feed board assembly 200' of FIGS. 2B-2C). Metal may be deposited onto these curved surfaces to provide reliable transmission paths that may carry RF signals between metallization on each dipole section 254 and metallization on the feedboard section 240.

The frame 230 may comprise, for example, a plastic frame that has suitable dielectric properties. Preferably the plastic is lightweight, low cost, easy to injection mold, and, maintains its electrical properties over a broad temperature range.

Metal patterns 270 may be selectively deposited onto the frame 230 to complete the feedboard assembly 200. The metal patterns 270 may include, for example input pads 272 (see FIG. 2B), RF transmission lines 274, dipole radiators 276 (see FIG. 2C), directors 278 and ground vias 279. The input pads 272 may be metalized pads or other structures on the feedboard section 240 that are suitable for receiving an external RF transmission line that carries RF signals to and from the feedboard assembly 200. The external RF transmission line may comprise, for example, a coaxial, cable. The input pads 272 may comprise, for example, first and second input pads 272-1, 272-2. In some embodiments, the center conductor of the coaxial cable may be soldered to the first input pad 272-1 and the outer conductor of the coaxial cable may be soldered to the second input pad 272-2. The first input pad 272-1 may, for example, be on the top surface of the feedboard 210 (see FIG. 2B) and the second input pad 272-2 may be part of the outer ground area on the bottom surface of the feedboard 210 (see FIG. 2C). More than one set of input pads 272 may be provided. For example, if the radiating elements 220 comprise cross-dipole radiating elements 220, then two sets of input pads 272 would typically be provided, where the first set of input pads 272 is used to carry signals having a +45 degree polarization to and from the feedboard assembly 200, and the second set of input pads 272 is used to carry signals having a −45 degree polarization to and from the feedboard assembly 200. In some embodiments, each RF transmission line 274 may include a splitter/combiner that divides the RF signals that are fed to the feedboard assembly 200 into two sub-components and provides a sub-component to each of the radiating elements 220. The splitter combiner likewise combines signals that are received at the two radiating elements 220 into a single, composite signal. The splitter/combiner may be implemented as a branched metal trace that is formed on the frame 230 in some embodiments.

The dipole radiators 276 may be formed by selectively depositing metal on the dipole sections 254 of frame 230. Metal may be deposited on all four radially extending arms 256 to form cross-dipole radiators 276 on each dipole section 254. The metal deposited on arms 256-1, 256-2 forms a first dipole that transmits and receives signals having a +45 degree polarization, while the metal deposited on arms 256-3, 256-4 forms a second dipole that transmits and receives signals having a −45 degree polarization. In the depicted embodiment, the dipole radiators 276 are selectively deposited on the bottom surfaces of the dipole sections 254 of frame 230, as shown in FIG. 2C. In other embodiments, the dipole radiators 276 may be deposited on the top surface of the dipole sections 254. In such embodiments, conductive vias may be formed through the dipole sections 254 to electrically connect the dipole radiators 276 to respective RF transmission lines 274. Directors 278 may likewise be formed by selectively depositing metal on the planar sections 264 of director support sections 260. As known to those of skill in the art, directors are parasitic metal elements that are mounted a pre-selected distance above a radiating element for purposes of, for example, improving the impedance match of the dipole antenna. The directors 278 may be planar in some embodiments, as shown. It will be appreciated, however, that three-dimensional directors 278 may be used in some embodiments in which case the planar upper shelf 264 may be replaced with a three-dimensional structure of the appropriate shape. In the depicted embodiment, the directors 278 are formed in a "double arrow" shape. This shape may help make the radome of the antenna 100 transparent to the high band radiating elements 220 and may also improve the dipole impedance match.

While the director support sections 269 and the directors 278 are formed as part of the monolithic feedboard assembly 200, it will be appreciated that, in other embodiments, only the director support sections 260 may be part of the monolithic feedboard assembly 200. This may allow one of several different sized, separately manufactured directors to be installed on the director support sections 260 in order to tune the performance of individual radiating elements and/or the antenna. In such embodiments, the top of each director support section 260 may, for example, include a clip that a separate director may be mounted on during the assembly process. Additionally, as shown in FIGS. 2B and 2C, in some embodiments, the director support sections 260 and directors 278 may be entirely omitted.

The RF transmission lines 274 may extend along the feedboard section 240 of frame 230 onto the stalk sections 252, and from the stalk sections 252 onto the dipole sections 254 (see FIGS. 2B and 2C). Thus, the RF transmission lines 274 may provide an RF communications path from each pair of input pads 272 to the dipole radiators 276. Ground vias 279 may extend through the feedboard section 240 of frame 230. The ground vias 279 may connect ground planes on each of the stalk sections 252 to a ground plane on the bottom surface of feedboard section 240.

Other circuit elements such as, for example, inductors (e.g., meandering transmission line segments) and/or capacitors (e.g., plate capacitors implemented by forming metal plates on opposite sides of a thin segment of the frame 230) may be formed by selectively depositing metal on the frame 230. These circuit elements may be provided for impedance matching or other purposes. Open circuit stubs may be formed by selective metallization that extend from the RF transmission lines 274. These open circuit stubs may, for example, help reduce coupling between the low band radiating elements 320 and the high band radiating elements 220.

In some embodiments, the metal may be selectively deposited on the frame 230 using laser direct structuring. With laser direct structuring, the thermoplastic material that is used to form the frame 230 may be doped with a metal-plastic additive material that may be activated by means of a laser. The portions of the frame 230 where metal is to be deposited may be treated by a laser which creates micro-scale roughness on the surfaces of the frame 230. The metal particles from the metal-plastic additive material that are present in these roughened areas serve as a seed layer for subsequent metallization. The metallization may be comprise an electroless metal bath (e.g., a copper bath) in which copper is deposited on the roughened areas treated by the laser. Successive layers of metal such as copper, nickel, gold and the like may then be formed on the initial metal layer to form the metal patterns 270.

In some embodiments, the metal layers may not include any nickel (or other ferromagnetic materials) as is typically used in laser direct structuring processes. The use of ferromagnetic metals may give rise to PIM distortion which may be a significant concern in base station antenna applications due to the high RF power levels.

Figure 3:
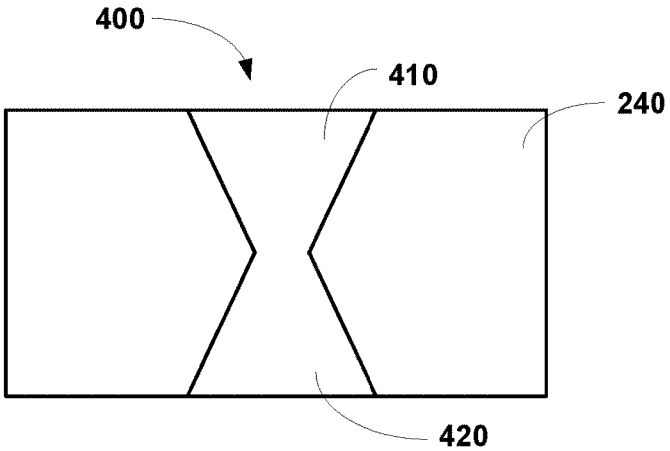
FIG. 3 is a cross-sectional view of a conductive via included in the feedboard assembly of FIG. 2A.

In some embodiments, the laser direct structuring may be used to form conductive connections that extend through the frame 230. For example, a cable from a phase shifter, a diplexer or the like may be connected to input pads 272 located on the bottom side of the feedboard section 240 in order to avoid routing the cable through the reflector 112 onto the top surface of the reflector 112. RF signals may be transferred to and from the feedboard assembly 200 via this cable. In order to pass signals between the radiating elements 220 to the cable, it may be necessary to form a conductive via or other conductive path through the frame 230. As shown in FIG. 3, this may be accomplished, for example, by forming a first truncated cone-shaped opening 410 in the upper surface of the feedboard section 240 (with the large end of the cone being at the upper surface) and forming a second truncated cone-shaped opening 420 in the lower surface of the feedboard section 240 (again with the large end of the cone being at the lower surface) directly beneath the first cone shaped opening 410. Together, these two truncated cone-shaped sections 410, 420 may form a generally hourglass shaped via 400 through the feedboard section 240 of frame 230. Moreover, by using the truncated cone-shaped openings 400, a laser may readily be used to illuminate the inner surface of the opening in order to allow metallization of the interior of the opening.

While laser direct structuring is one technique that may be used to form the monolithic radiating elements and feedboard assemblies according to embodiments of the present invention, different techniques for selectively metalizing a three-dimensional plastic frame may be used such as vacuum metallization, electroplating, microscopic integrated processing technology and the like.

While the feedboard assemblies 200, 200 depicted in FIGS. 2A-2C each include two radiating elements 220, it will be appreciated that other numbers of radiating, elements may be included. For example, as shown in FIG. 1A, some of the high band feedboard assemblies on antenna 100 include three radiating elements 220 mounted on a feedboard. These feedboard assemblies could also be implemented using the various techniques for selectively depositing metal on a three-dimensional frame that are described herein.

The feed board assemblies 300 for the low band radiating elements 320 may also be formed by selective metallization of an injection molded plastic frame. However, with the feedboard assemblies 300, only part of each low band radiating element 320 is formed in this fashion, as will be discussed in greater detail with reference to FIGS. 4A-4B.

Figure 4A:
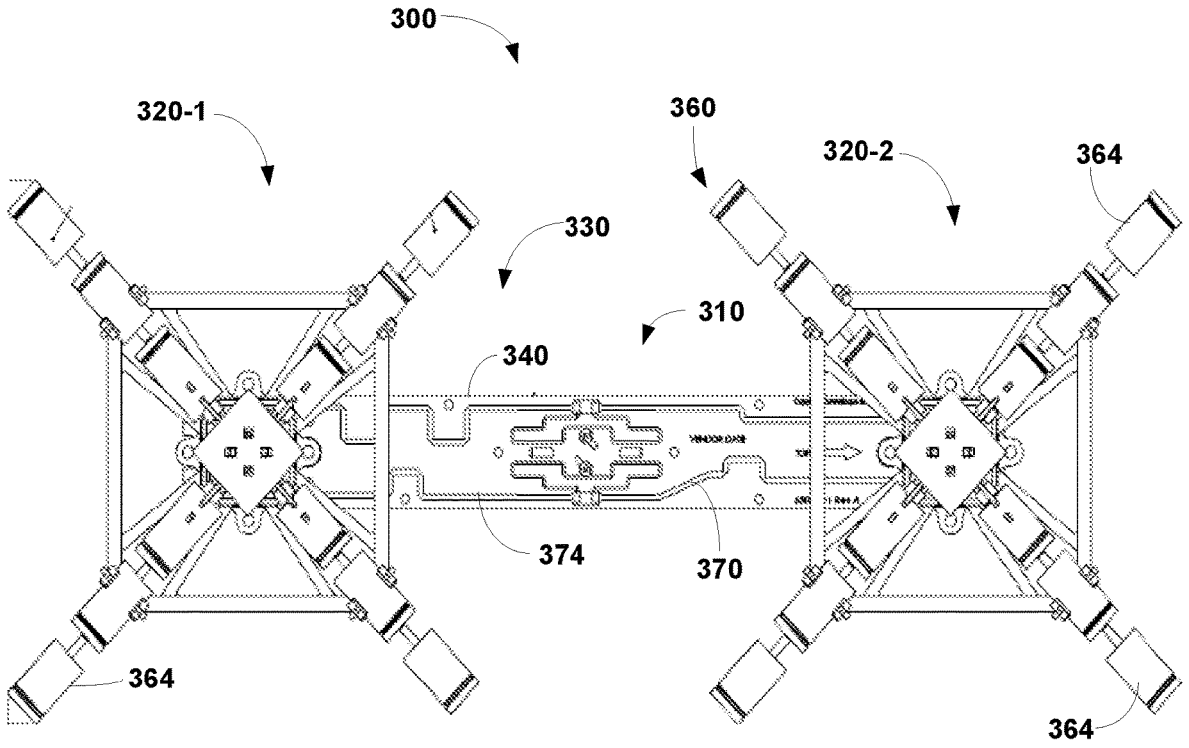
FIG. 4A is a front view of a feed board assembly according to further embodiments of the present invention.
Figure 4B:
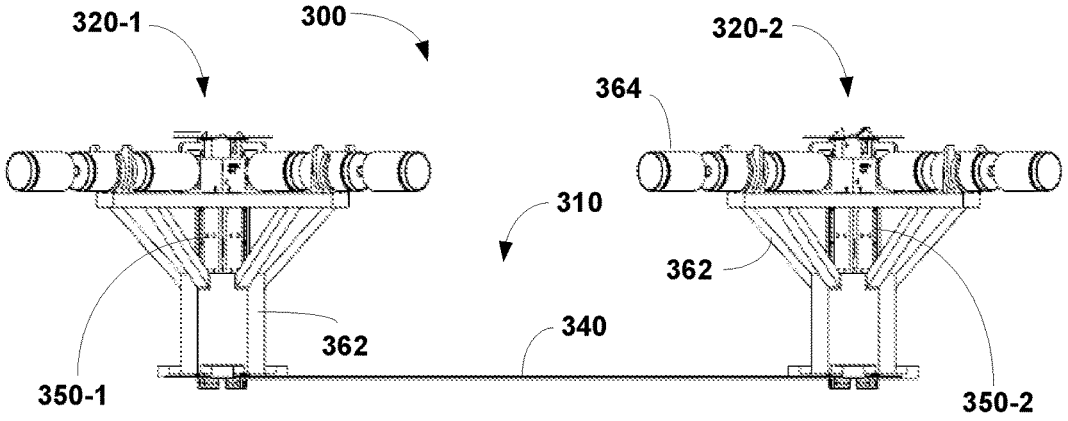
FIG. 4B is a side view of the feed board assembly of FIG. 4A.

In particular, FIG. 4A is a front view of the feed board assembly 300. FIG. 4B is a side view of the feed board assembly 300 of FIG. 4A. The feedboard assembly 300 comprises a feedboard 310 and a pair of radiating elements 320-1, 320-2. The feedboard 310 and the lower portion of each radiating element 320 may be formed using an injection molded frame 330 that has metal patterns 370 selectively deposited thereon. The frame 330 may include a generally planar feedboard section 340 and first and second stalk sections 350-1, 350-2 that extend upwardly from the feedboard section 340. The stalk sections 350 may position separate dipole radiators 360 (described below) at a desired distance above the reflector 112.

The frame 330 may comprise a monolithic plastic frame that may be formed, for example, by injection molding. Bottom portions of the stalk sections 350 may be thicker than the central and upper portions thereof and may merge into the feedboard section 340 along curved surfaces. Metal may be deposited onto these curved surfaces to provide reliable transmission paths that may carry RF signals between the stalk sections 350 and the respective feedboard sections 340.

Metal patterns 370 may be selectively deposited onto the frame 330 to complete the feedboard assembly 300. The metal patterns 370 may include, for example, input pads (not visible) and RF transmission lines 374. The input pads may be metalized pads or other structures on the feedboard section 320 that are suitable for receiving an external RF transmission line (e.g., a coaxial cable) that carries RF signals to and from the feedboard assembly 300. The input pads may be similar or identical to the input pads 272 discussed above and hence further description thereof will be omitted.

Cross-dipole radiators 360 may be mounted on the respective stalks 350. A dipole support 362 may be provided for each radiating element 320 that supports the respective cross-dipole radiators 360. In the depicted embodiment, the dipole supports 362 comprise separate structures. However, it will also be appreciated that in, other embodiments the dipole, supports 362 may be formed as part of the frame 330.

Each dipole radiator 360 may, for example, comprise four dipole arms 364 that are each between a ⅜ to ½ of a wavelength in length, where the "wavelength" refers to the wavelength in approximately the middle of the frequency range of the low band. The four dipole radiators 360 are arranged in the shape of a cross. Two of the four dipole arms 364 together form a first radiator that transmits and receives signals having a first polarization (e.g., a +45 degree polarization), while the remaining two dipole arms 364 together form a second radiator that transmits and receives signals having a second, orthogonal polarization (e.g., a −45 degree polarization). Each dipole arm 364 may comprise an elongated center conductor that has a series of coaxial chokes mounted thereon. Each coaxial choke may comprise a hollow metal tube that has an open end and a closed end that is grounded to the center conductor. The coaxial chokes are used to create a quarter wavelength well in the high frequency band that may makes the low band radiating element 320 substantially invisible to transmission in the high frequency band.

The RF transmission lines 374 may extend along the feedboard section 340 of frame 330 onto the stalk sections 350. At the top of each stalk section 350, the crossed-dipole radiators 360 are connected to the stalk sections 350. The stalk sections 350 may include output pads at the locations where each crossed-dipole radiator 360 connects to the stalk section 350 to provide RF transmission paths between the stalk sections 350 and the crossed-dipole radiators 360. The RF transmission lines 374 may terminate into these output pads. Inductors in the form of meandering transmission line segments may also be provided at the portion of each stalk section 350 where the crossed-dipole radiators 360 are mounted which, in conjunction with a coaxial capacitor that is implemented as part of each crossed-dipole radiator 360, form a series inductor-capacitor circuit that impedance match the transmission lines 374 to the crossed-dipole radiators 360.

While the dipole radiators 360 are implemented as separate components that are mounted on the frame 330 in the above example, it will be appreciated that in further embodiments the dipole radiators may be implemented as part of the monolithic feedboard assembly 300, in a manner similar to feedboard assembly 200.

The metal may be selectively deposited on the frame 330 using laser direct structuring, vacuum metallization, electroplating, microscopic integrated processing technology and the like.

Figure 5A:
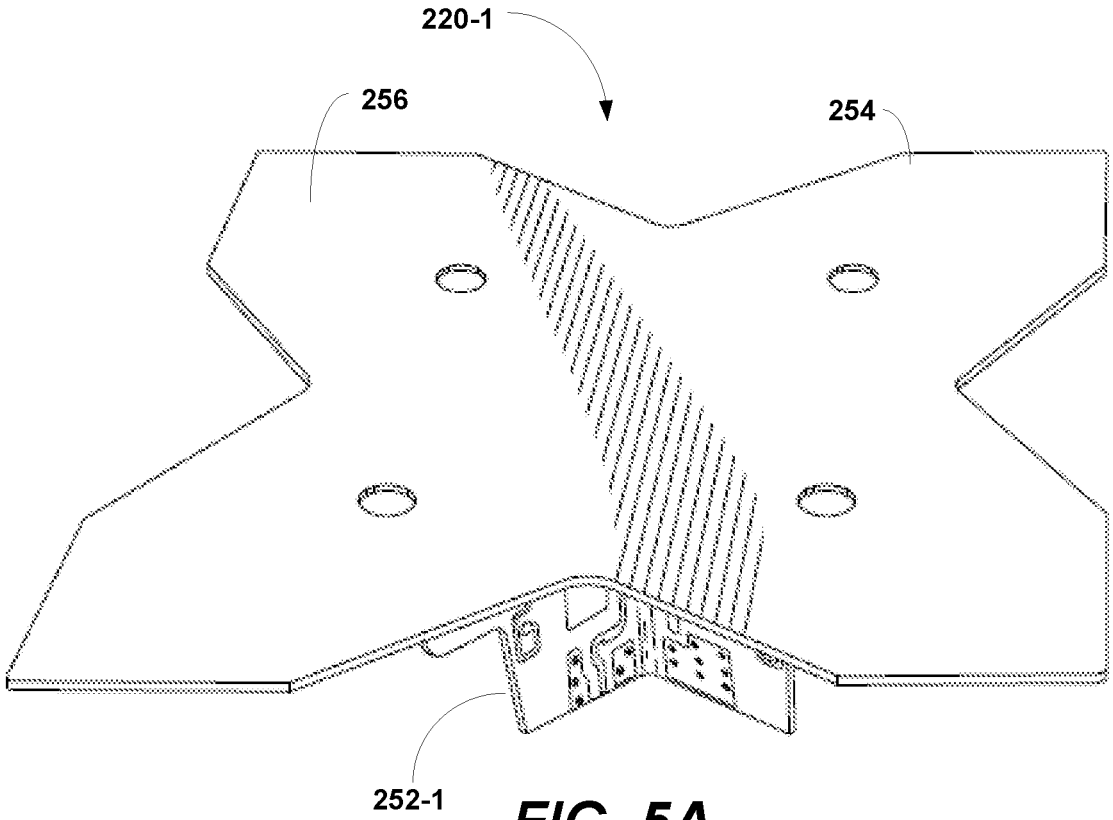
FIG. 5A is a top perspective view of a monolithic radiating element according to embodiments of the present invention.
Figure 5B:
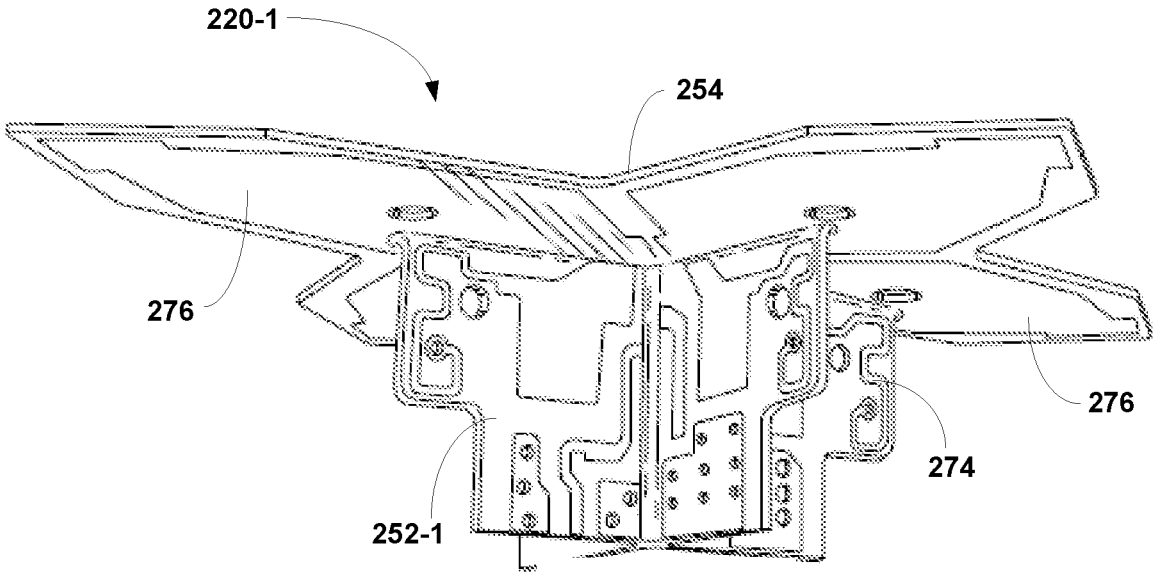
FIG. 5B is a side perspective view of the monolithic radiating element of FIG. 5A.

It will also be appreciated that in some embodiments the entire feedboard assembly need not be formed as a single monolithic unit. For example, as shown in FIGS. 5A and 5B, in some embodiments each radiating element 220 may be implemented as a single monolithic unit. The radiating elements 220 may then be soldered to a feedboard or coaxial cables may be soldered directly to each such radiating element. In the embodiment of FIGS. 5A-5B, the bottom surfaces of the stalk sections 252 are not widened, which may facilitate mounting the stalk sections 252 by inserting the stalk section 252 through slots in a separate feedboard (not shown) and soldering the stalk sections 252 to the separate feedboard in order to mechanically mount and electrically connect the radiating elements 220 to the separate feedboard.

The plastic frames may be designed to improve and/or optimize various electrical parameters of the feedboard assemblies, such as return loss, insertion loss, RF power handling and PIM distortion. Properties of the plastic frame that effect the beam patterns of the antenna must also be carefully considered. In some embodiments, the portions of the plastic frame that include RF transmission lines thereon may have a relatively constant thickness to provide good impedance matching and consistent electrical performance.

In some embodiments, the plastic frames 230, 330 may include three-dimensional shapes that are selectively metalized for purposes of reducing cross-coupling between various of the elements of the antenna 100. For example, isolation structures may be formed to extend upwardly from the feedboard sections 240, 340 that are selectively metalized to reduce coupling between the radiating elements 220, 320 and various other elements on the antenna (e.g., radiating elements of other linear arrays).

The monolithic radiating elements and feedboard assemblies according to embodiments of the present invention may have various advantages as compared to conventional radiating elements and feedboard assemblies for base station antennas. For example, the radiating elements and feedboard assemblies according to embodiments of the present invention may significantly reduce the overall number of components included in a base station antenna, reducing assembly time and the overall cost of the antenna. Additionally, the monolithic structures disclosed herein may significantly reduce the number of soldering operations required to construct the antenna, which again reduces assembly time and costs, reduces the amount of PIM distortion testing necessary, and which may result in an improvement in the PIM distortion performance of the antenna. The feedboard assemblies according to embodiments of the present invention may also exhibit improved reliability.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, hut do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A method of fabricating a monolithic feedboard assembly for a base station antenna, the method comprising:

injection molding a unitary frame that includes a feedboard section configured to be mounted on a reflector and a radiating element section having a stalk section that extends upwardly from the feedboard section and a dipole section that is mounted above the feedboard section by the stalk section;

selectively depositing metal on the unitary frame to form radio frequency (RF) transmission lines and dipole radiators on the unitary frame to form the monolithic feedboard assembly.

2. The method of claim 1, wherein selectively depositing metal on the unitary frame to form RF transmission lines and dipole radiators on the unitary frame to form the monolithic feedboard assembly comprises selectively forming the RF transmission lines and the dipole radiators on the unitary frame via laser direct structuring.

3. The method of claim 1, wherein the radiating element section is a first radiating element section, and wherein the unitary frame includes a second radiating element section, the first and second radiating element sections extending upwardly from a top surface of the feedboard section.

4. The method of claim 1, wherein a first of the RF transmission lines extends along a bottom portion of the stalk section that merges into the feedboard section along a first curved surface.

5. The method of claim 4, wherein the first of the RF transmission lines also extends along a top portion of the stalk section that merges into the dipole section along a second curved surface.

6. The method of claim 5, wherein the top portion and the bottom portion of the stalk section are thicker than a central portion of the stalk section.

7. The method of claim 4, wherein the dipole radiators are formed on an exposed bottom surface of the dipole section.

8. The method of claim 4, wherein the dipole radiators are formed on an exposed top surface of the dipole section, and conductive vias electrically connect the dipole radiators to respective ones of the RF transmission lines.

9. The method of claim 8, wherein the conductive vias each have an hourglass shape and are metallized using laser direct structuring.

10. The method of claim 4, wherein the unitary frame further includes a director support section that extends above the dipole section.

11. The method of claim 1, wherein the unitary frame comprises a thermoplastic material doped with a metal-plastic additive.

12. The method of claim 1, wherein the feedboard section includes metalized isolation structures extending upwardly therefrom.

13. A monolithic, selectively metalized feedboard assembly for a base station antenna, comprising:

a monolithic frame that is plastic and includes a feedboard section configured to be mounted on a reflector and a radiating element section having a stalk section that extends upwardly from the feedboard section and a dipole section that is mounted above the feedboard section by the stalk section; and radio frequency (RF) transmission lines and dipole radiators formed directly on the monolithic frame, wherein connections between the RF transmission lines and the dipole radiators are free of solder joints.

14. The monolithic, selectively metalized feedboard assembly of claim 13, wherein a first of the RF transmission lines extends between the feedboard section and the stalk section over a bottom portion of the stalk section that merges into the feedboard section along a first curved surface.

15. The monolithic, selectively metalized feedboard assembly of claim 14, wherein the first of the RF transmission line also extends between the stalk section and the dipole section over a top portion of the stalk section that merges into the dipole section along a second curved surface.

16. The monolithic, selectively metalized feedboard assembly of claim 13, wherein a top portion and a bottom portion of the stalk section are thicker than a central portion of the stalk section.

17. The monolithic, selectively metalized feedboard assembly of claim 13, wherein the dipole radiators are formed on a bottom surface of the dipole section.

18. The monolithic, selectively metalized feedboard assembly of claim 13, wherein the dipole radiators are formed on a top surface of the dipole section, and conductive vias electrically connect the dipole radiators to respective ones of the RF transmission lines.

19. The monolithic, selectively metalized feedboard assembly of claim 18, wherein the monolithic frame further includes a director support section that extends above the dipole section.

* * * * *